US007341767B1

(12) United States Patent
Velinsky

(10) Patent No.: US 7,341,767 B1
(45) Date of Patent: Mar. 11, 2008

(54) SYSTEM AND METHOD FOR DISPLAYING POM PONS

(76) Inventor: Frank J. Velinsky, 15221 Cedar Cir., Omaha, NE (US) 68144

( * ) Notice: Subject to any disclaimer, the term of this patent is extended or adjusted under 35 U.S.C. 154(b) by 497 days.

(21) Appl. No.: 11/012,681

(22) Filed: Dec. 15, 2004

(51) Int. Cl.
*A47G 1/16* (2006.01)
*A47G 29/00* (2006.01)
*A47F 5/00* (2006.01)

(52) U.S. Cl. ..... 428/4; 40/584; 40/604; 40/617; 40/729; 40/730; 40/731; 40/732; 40/733; 211/13.1; 211/71.01; 211/113; 211/115; 211/116; 211/169; 248/689; 248/489

(58) Field of Classification Search ..... None
See application file for complete search history.

(56) References Cited

U.S. PATENT DOCUMENTS

| | | | | | |
|---|---|---|---|---|---|
| 1,878,444 | A | * | 9/1932 | Kopp | 248/158 |
| 1,898,769 | A | * | 2/1933 | Gleason | 428/21 |
| 2,044,949 | A | * | 6/1936 | Levy et al. | 446/374 |
| 2,529,403 | A | * | 11/1950 | Mack, Sr. | 211/100 |
| 2,562,093 | A | * | 7/1951 | Heisler | 211/101 |
| 2,665,011 | A | * | 1/1954 | Simjian | 211/99 |
| 3,011,632 | A | * | 12/1961 | High | 206/746 |
| 3,339,744 | A | * | 9/1967 | Ginsberg | 211/1.54 |
| 3,419,973 | A | * | 1/1969 | Manotas, et al. | 434/198 |
| 3,452,881 | A | * | 7/1969 | Jamison | 211/119 |
| D217,362 | S | * | 4/1970 | Weinman | D6/315 |
| 3,673,723 | A | * | 7/1972 | Lazar et al. | 40/729 |
| 4,253,576 | A | * | 3/1981 | Ford et al. | 211/70 |
| 4,319,419 | A | * | 3/1982 | Traill | 40/729 |
| D272,501 | S | * | 2/1984 | Rutishauser | D6/327 |
| 4,429,797 | A | * | 2/1984 | Collins | 211/119 |
| 4,697,712 | A | * | 10/1987 | Valiulis | 211/187 |
| 4,806,396 | A | * | 2/1989 | Pratt et al. | 428/4 |
| D333,731 | S | * | 3/1993 | Klein et al. | D6/317 |
| 5,244,700 | A | * | 9/1993 | Banschick | 428/4 |
| 5,249,668 | A | * | 10/1993 | Fenton et al. | 206/756 |
| 5,380,568 | A | * | 1/1995 | Banschick | 428/4 |
| 5,437,378 | A | * | 8/1995 | Ta | 211/115 |
| 6,176,756 | B1 | * | 1/2001 | Panec | 446/99 |
| 6,575,808 | B1 | * | 6/2003 | Wright et al. | 446/321 |
| 2003/0173474 | A1 | * | 9/2003 | Taylor | 248/156 |

FOREIGN PATENT DOCUMENTS

EP 0165862 * 12/1985

* cited by examiner

*Primary Examiner*—Vivian Chen
(74) *Attorney, Agent, or Firm*—Thomte Law Office; Dennis L. Thomte

(57) ABSTRACT

A system for storing and displaying pom pons is provided with a frame and a plurality of securement members positioned in a spaced-apart relationship with one another along opposite side portions of the frame. The securement members releasably secure the gripping portion of pom pons. A multi-segmented frame may be provided that allows the segments to move independently from one another. Spirit adornment may be provided to the frame as well as shaping the frame itself to exhibit such adornment. Various hanging and ground supports are provided for supporting the frames.

12 Claims, 4 Drawing Sheets

SYSTEM AND METHOD FOR DISPLAYING POM PONS

BACKGROUND OF THE INVENTION

1. Field of the Invention

The present invention relates to displays and more particularly to a display system for several pairs of pom pons while hanging above the floor or supported on a stand.

2. Description of the Prior Art

Cheerleading has been a popular activity in high school and college for years. Pom pons play key symbolic and functional roles in nearly every cheer squad. Pom pons are typically found in two different styles. The baton style provides a generally cylindrical baton that serves as a handle between the pons that extend from its opposite end portions. The pons themselves are typically comprised of a plurality of strips of colored material together to form a generally spherical shape. The second style of pom pon provides a single pon that extends outwardly from a handle. Regardless of the style of pom pon used, it is common for a cheerleader to have several different pairs of pom pons over the course of a cheerleading career. Certain styles and colors may be used from one squad to another or from one competition to another.

The prior art currently provides for no simple and effective method of simultaneously storing and displaying pom pons. Storing pom pons in duffle bags or storage containers provides no manner of display and only serves to cause the poms to crush and become permanently disfigured over time. Moreover, such storage methods may cause or promote the growth of mildew in certain environments. Preferably, any long term storage solution should provide a reasonable amount of airflow through the poms and prevent long term deformation of the poms and their individual pieces of material. Due to the fact that a cheerleader may have several pairs of pons to display and store, such a storage system will also have to be adaptable to be used with several pairs of pom pons at the same time.

SUMMARY OF THE INVENTION

The system for displaying pom pons of the present invention is generally provided with a frame having upper and lower end portions and opposite side portions. A plurality of securement members are positioned in a spaced-apart relationship with one another along the opposite sides of the frame in a diametric fashion to selectively secure one or more pairs of pom pons adjacent to the frame. In one embodiment, the frame may be suspended above the ground. In another embodiment, a stand may be provided to extend upwardly from the ground and support the frame.

In one alternate embodiment, the frame is provided in a plurality of separate segments that are coupled to one another. Each segment may be allowed to move independently with respect to adjacent segments. Lettering, symbols and other spirit-related adornment may be provided on the frame. Likewise, the frame may itself be shaped to display lettering, symbols or other such adornment.

It is therefore a principle object of the present invention to provide a system and method for storing and displaying pom pons.

It is a further object of the present invention to provide a pom pon display that secures pom pons in a spaced-apart manner that substantially limits deformation of individual pons.

Still another object of the present invention is to provide a pom pon display that may be hung from a ceiling or wall.

Yet another object of the present invention is to provide a pom pon display having a multi-segmented frame, wherein each individual segment is independently movable with respect to one another.

Still another object of the present invention is to provide a pom pon display that diametrically orients pairs of pom pons in a lineal fashion.

A further object of the present invention is to provide a pom pon display that is easily adapted to display spirit adornment, such as letters and symbols, while displaying pairs of pom pons.

Yet another object of the present invention is to provide a pom pon display that is relatively simple to manufacture and use.

Still another object of the present invention is to provide a pom pon display that stores and displays pom pons in a manner that permits sufficient air circulation through the pom pons to substantially reduce of the likelihood of mildew growth on the pom pons.

These and other objects of the present invention will be apparent to those skilled in the art.

DESCRIPTION OF THE PREFERRED EMBODIMENT

Figure 1:
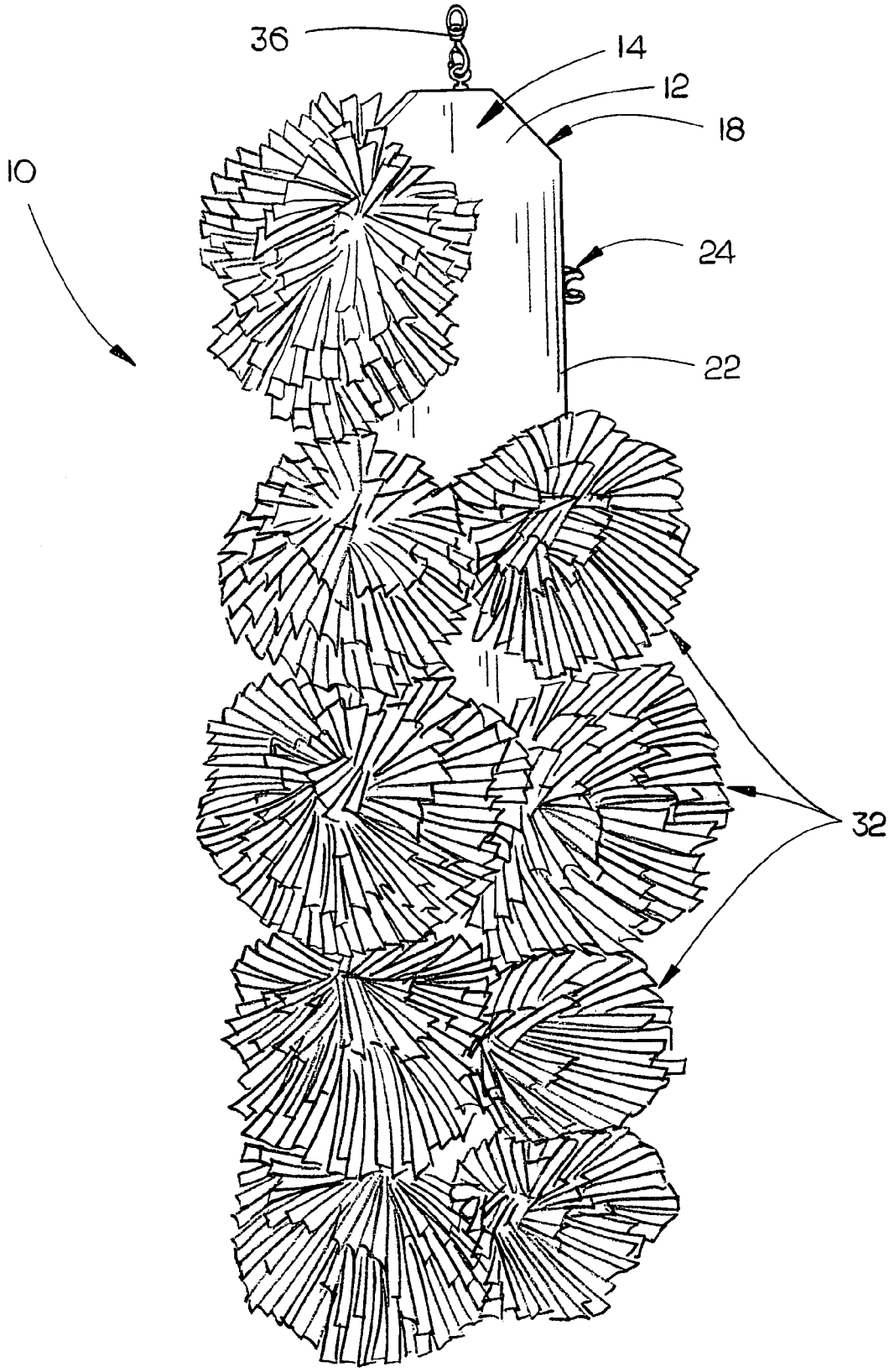
FIG. 1 is a perspective view of one embodiment of the pom pon display of the present invention as the same could be used to store and display pairs of pom pons.

In the following detailed description of exemplary embodiments, references are made to accompanying FIGS. 1-4, which form a part hereof and illustrate exemplary embodiments that may be implemented in order to practice the present invention. These embodiments are disclosed in sufficient detail to enable those skilled in the art to practice the invention. It should be understood, however, that other embodiments may be utilized and changes may be made to the illustrated embodiments without departing from the spirit or scope of the present invention. The following detailed descriptions are, therefore, not to be taken in a limiting sense and the scope of the present invention is defined only by the appended claims.

The pom pon display 10 of the present invention is generally provided with a frame 12 having an upper end portion 14 and a lower end portion 16. Each of the frames depicted in the Figures are represented as being elongated and planar in fashion, having a peripheral edge portion 18 and opposite side portions 20 and 22. It is contemplated, however, that the frame 12 could be provided in nearly any shape and in a wide variety of configurations. Cylindrical, round, spherical, square and other shapes ate contemplated without departing from the scope of the present invention.

Figure 2:
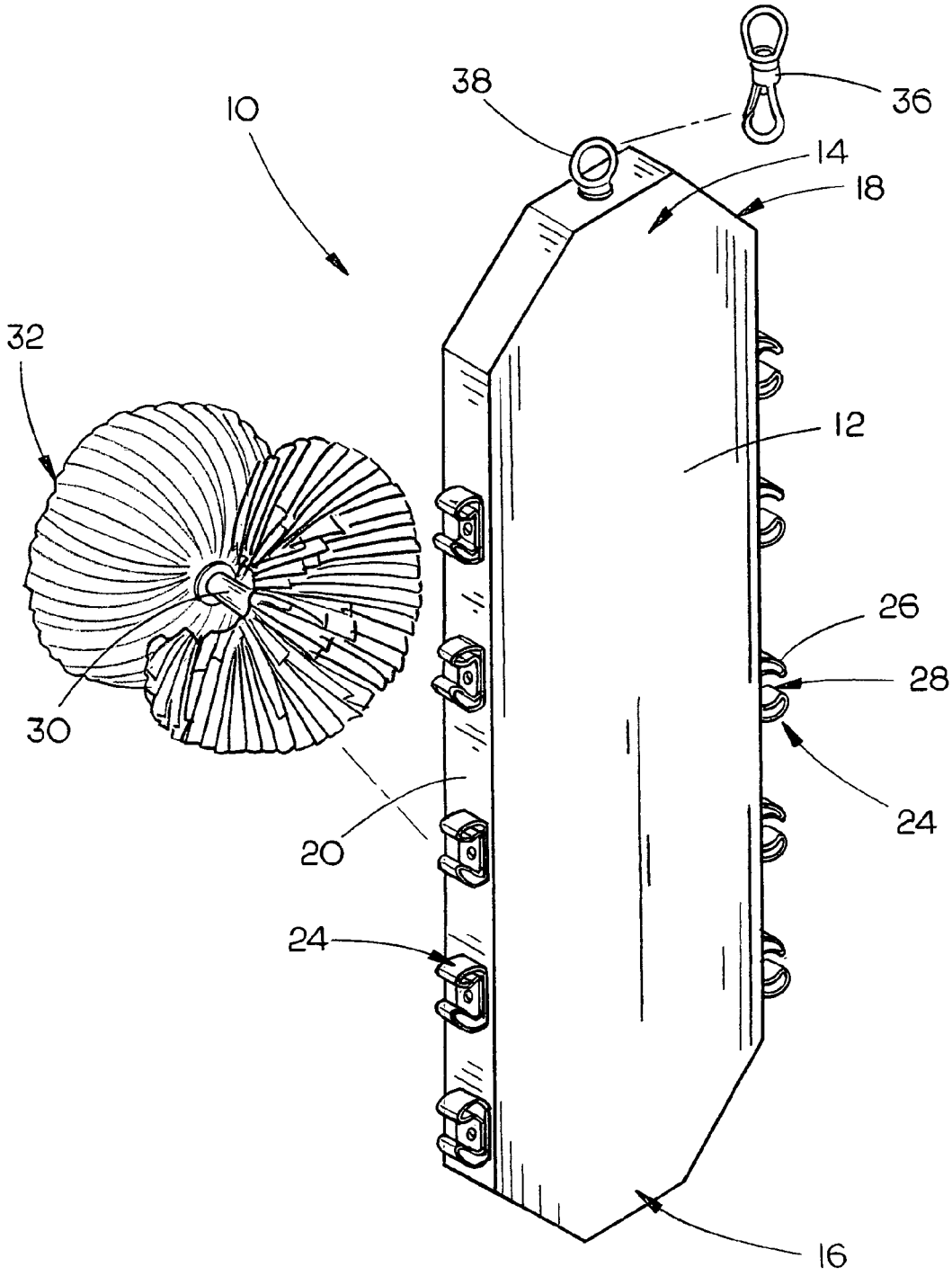
FIG. 2 is an isometric view of one embodiment of the pom pon display of the present invention, depicting one method of securing pom pons to the display frame.

A plurality of securement means are preferably coupled with the frame 12 in a spaced-apart relationship with one another. Different materials, shapes and configurations may be used when forming the securement members. For example, generally deformable yet resilient clips 24 may be disposed along the frame 12. Each of the clips 24 are provided with opposing jaws 26 that define a cavity 28 therebetween. As depicted in FIG. 2, the baton 30 of a pom pon 32 may be pressed between the jaws 26 and into a secure position within the cavity 28. It is contemplated that the clips 24 could be used to secure other types of pom pons, including those having handles, rather than batons. Alternately, the securement members may be provided using elongated flexible members, such as strips of fabric, yarn or the like. Another alternate securement member could be provided by simply cutting channels or openings through the frame 12. Such channels or openings would be sized and shaped to accommodate the baton or handle of the pom pon and may be sized to prevent the passage of the poms disposed at the ends of the pom pon therethrough.

The securement members, such as the clips 24 may be disposed along the frame 12 in nearly any position and on nearly any surface of the frame 12. Diametric arrangements of the securement members in a spaced-apart fashion provide for arrangements such as those depicted in FIG. 1. The spaced relationship with one another is preferably provided such that deformation of the poms against one another or the frame 12 is substantially prevented.

Figure 3:
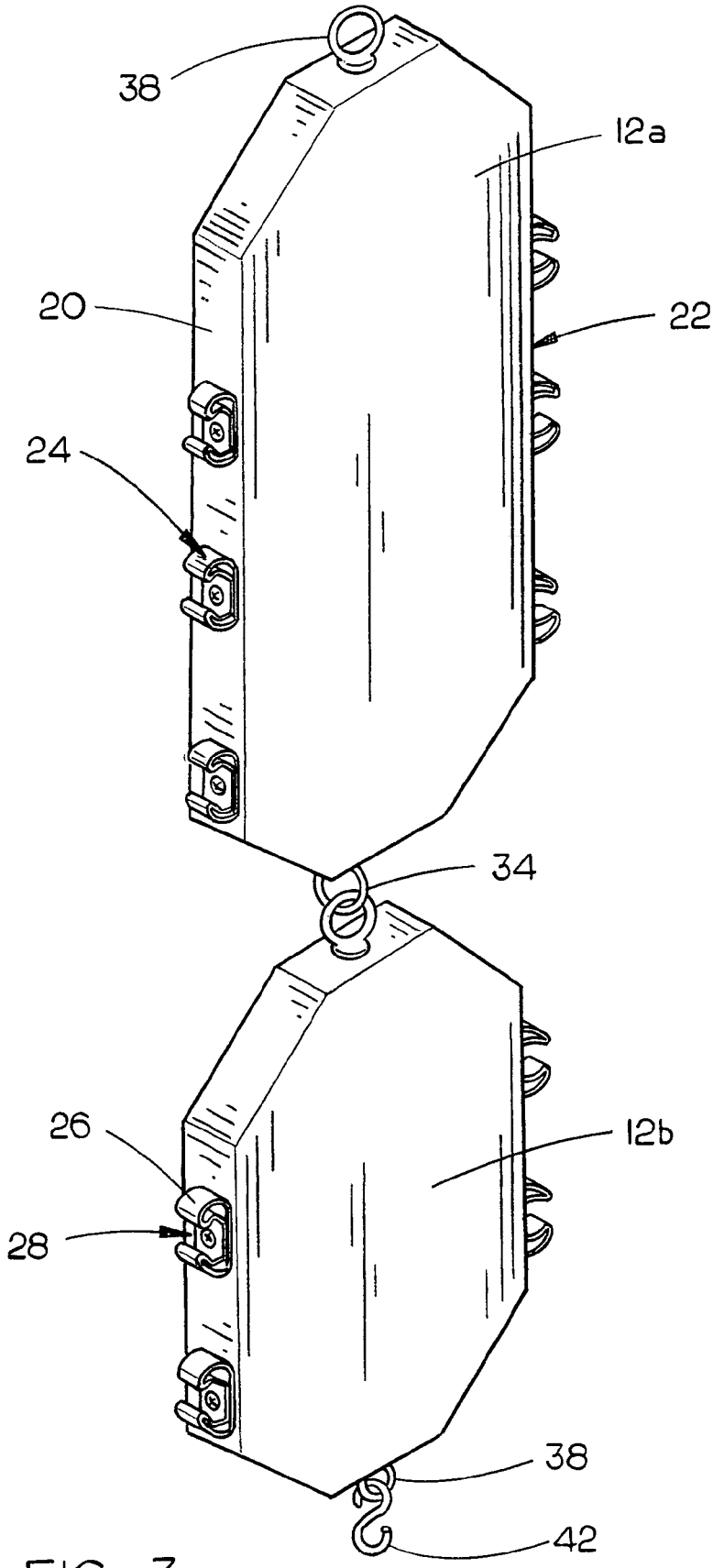
FIG. 3 is an isometric view of one alternate embodiment of the pom pon display of the present invention.

In one alternate embodiment, depicted in FIG. 3, the frame 12 may be provided in a plurality of separate frame segments 12*a* and 12*b*. While two segments are shown coupled to one another, it is contemplated that the number of individual segments is nearly limitless. Frame segments 12*a* and 12*b* are preferably coupled to one another so that the individual frame segments may move independently from one another. Accordingly, flexible cords, "S" hooks, chain links 34, swivel snaps 36, and the like may be used to couple the individual frame segments to one another. When desirable, the multiple frame segments 12*a* and 12*b* may be coupled to one another in a fixed relationship, substantially preventing movement of the segments with respect to one another.

In one preferred embodiment, it is contemplated that the pom pon display 10 could be hung from a ceiling or a bracket extending outwardly from a wall or support pole. Accordingly, a support means, such as an eyelet 38 may be coupled with the upper end portion of the frame 12. A swivel snap 36 may also be coupled therewith for supporting the frame 12 and permitting the frame 12 to turn freely about a vertical axis above the ground. The means may further be comprised of cords, chain links or other similar structural devices for coupling with a hook or other such device extending from the ceiling or from a bracket extending from a wall. Where it is desirable to have the frame 12 extending upwardly from the floor, a stand 40 may be coupled with the lower end portion 16 of the frame 12. The stand 40 may be provided to rotate or sit in a static manner.

Figure 4:
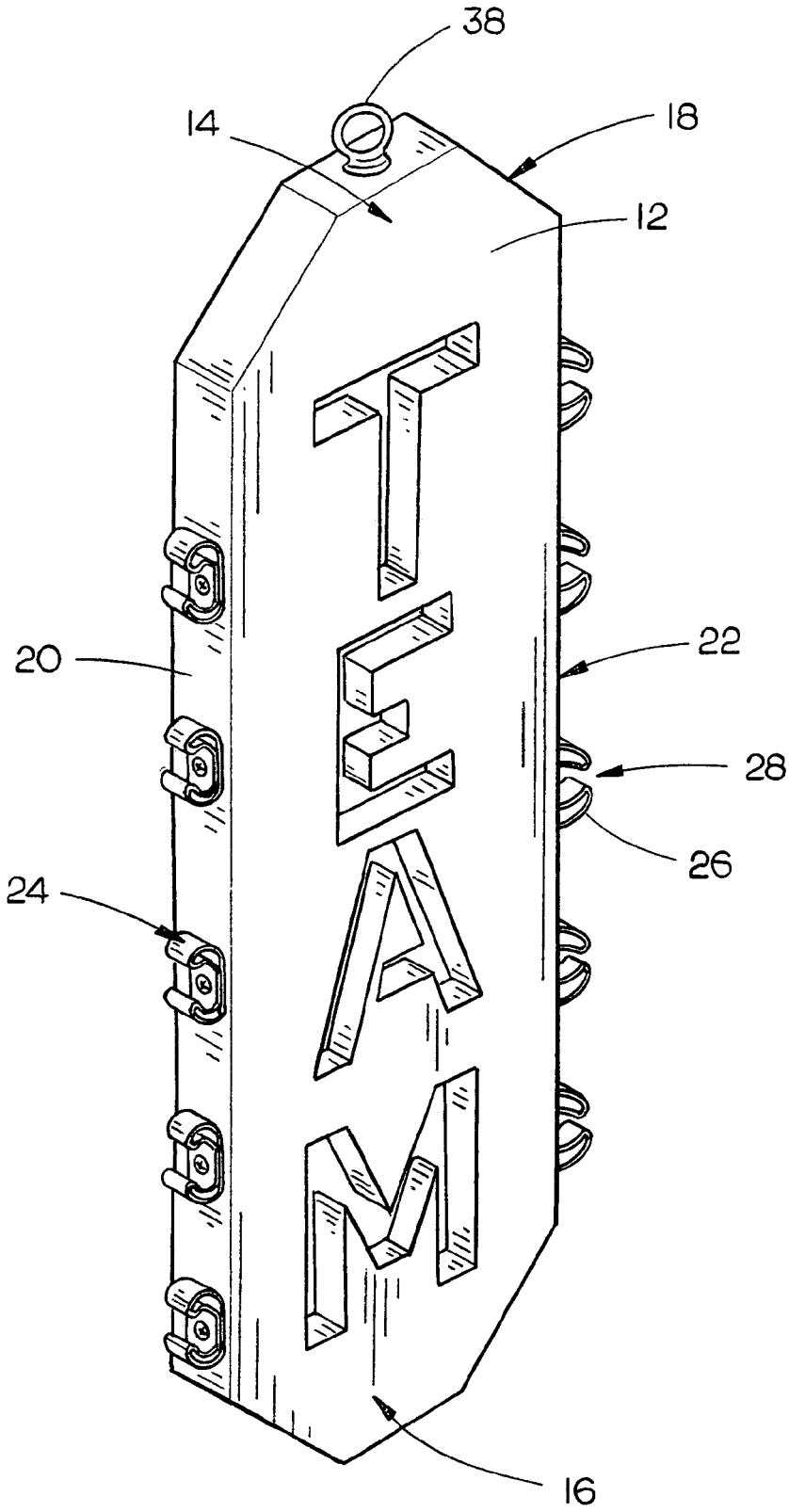
FIG. 4 is an isometric view of still another alternate embodiment of the pom pon display of the present invention as the same could be used to display one type of spirit adornment.

It may be preferable to provide lettering, numbers, symbols or other such spirit adornment to the pom pon display to further enhance its display purpose. One example of such adornment is depicted in FIG. 4, wherein channels or openings are formed into the pom pon display 10 to resemble the word "Team". It is also contemplated, however, that the peripheral edge portion 18 of the frame 12 could be shaped to resemble each individual letter or symbol. These letters or symbols may be integrally formed or forms to be separate frame segments that are coupled with one another. Separate spirit adornment of various forms could be secured to nearly any surface of the frame 12, or supported therefrom, such as by a hook 42, or the like.

In the drawings and in the specification, there have been set forth preferred embodiments of the invention and although specific items are employed, these are used in a generic and descriptive sense only and not for purposes of limitation. Changes in the form and proportion of parts, as well as a substitution of equivalents, are contemplated as circumstances may suggest or render expedient without departing from the spirit or scope of the invention as further defined in the following claims.

Thus it can be seen that the invention accomplishes at least all of its stated objectives.

I claim:

1. A system for displaying pom pons, comprising:

a frame having upper and lower end portions and opposite side portions;

a plurality of securement means positioned in a spaced-apart relationship with one another along said opposite side portions for selectively securing a plurality of pom pons adjacent said frame; and support means for positioning said frame so that the pom pons are supported above the ground;

said frame being provided in a plurality of separate segments that are operatively and movably coupled to one another.

2. The system of claim 1 comprising a connector between said plurality of separate segments that permits said plurality of separate segments to pivot with respect to one another about a common axis.

3. The system of claim 2 wherein said support means positions said frame so that said frame is suspended freely above the ground.

4. The system of claim 3 wherein said support means permits at least partial rotation of said frame about a vertical axis.

5. A system for displaying pom pons, comprising:

a frame having upper and lower end portions and opposite side portions;

a plurality of securement means positioned in a spaced-apart relationship with one another along said opposite side portions for selectively securing a plurality of pom pons adjacent said frame; and support means for positioning said frame so that the pom pons are supported above the ground;

said securement means being comprised of clips that are shaped and sized to receive gripping members on the pom pons.

6. The system of claim 5 wherein said clips are formed to be deformably resilient.

7. The system of claim 6 wherein said clips are diametrically positioned in pairs along a peripheral edge portion of said frame.

8. The system of claim 7 wherein said frame is provided in a plurality of separate segments that are operatively and movably coupled to one another.

9. The system of claim 8 comprising a connector between said plurality of separate segments that permits said plurality of separate segments to pivot with respect to one another about a common axis.

10. The system of claim 9 wherein said support means positions said frame so that said frame is suspended freely above the ground.

11. The system of claim 7 wherein said support means operatively engages and extends upwardly from the ground so that said frame is supported above the ground.

12. A system for displaying pom pons, comprising:

a frame having upper and lower end portions and opposite side portions;

a plurality of securement means positioned in a spaced-apart relationship with one another along said opposite side portions for selectively securing a plurality of pom pons adjacent said frame; and support means for positioning said frame so that the pom pons are supported above the ground;

said securement means being comprised of clips that are shaped and sized to receive gripping members on the pom pons;

said clips being formed to be deformably resilient;

said clips being diametrically positioned in pairs along a peripheral edge portion of said frame;

said frame being provided in a plurality of separate segments that are operatively and movably coupled to one another;

a connector between said plurality of separate segments that permits said plurality of separate segments to pivot with respect to one another about a common axis;

said support means positioning said frame so that said frame is suspended freely above the ground;

said support means permitting at least partial rotation of said frame about a generally vertical axis.

* * * * *